United States Patent [19]

Calloway

[11] Patent Number: 4,554,693

[45] Date of Patent: Nov. 26, 1985

[54] MATTRESS, BOX SPRINGS FABRIC

[75] Inventor: Brian Calloway, Moore, S.C.

[73] Assignee: American Fast Print Limited, Spartanburg, S.C.

[21] Appl. No.: 563,167

[22] Filed: Dec. 19, 1983

[51] Int. Cl.[4] ..... A47C 27/00

[52] U.S. Cl. ..... 5/448; 5/482; 428/253; 428/254

[58] Field of Search ..... 428/253, 254, 293, 294; 5/448, 482

[56] References Cited

U.S. PATENT DOCUMENTS

| | | | |
|---|---|---|---|
| 3,256,130 | 6/1966 | Nisbet et al. | 428/254 |
| 4,067,209 | 1/1978 | Kucera et al. | 428/254 |
| 4,304,812 | 12/1981 | Perkins | 428/253 |
| 4,425,398 | 1/1984 | Berczi | 428/254 |

*Primary Examiner*—James J. Bell

*Attorney, Agent, or Firm*—Wellington M. Manning, Jr.

[57] ABSTRACT

A body support element such as a mattress, box springs or the like that exhibits non-slip qualities as to a further item freely supported thereon. A ticking fabric covers at least an upper surface of the element includes a base fabric having pairs of yarns laid in atop said base fabric and secured thereto, the lay in yarns following non-linear paths. The yarns of each pair preferably follow mirror image paths to the opposite yarn of the pair. Processes for producing the ticking fabric and finishing same are also included.

21 Claims, 9 Drawing Figures

MATTRESS, BOX SPRINGS FABRIC

BACKGROUND OF THE INVENTION

The present invention relates to a mattress, box springs or other body supporting element having a slip resistant covering thereover.

Mattresses for use in conventional fashion, i.e., as support for a human body in a supine position basically include a framework or border of some sort, a resilient support means located within the border which is generally a series of interrelated coil spring formations, a foam structure, a water cell, or the like to properly support an individual residing thereon, and a cover material that generally fully encloses the support means and the frame. Such cover material is conventionally referred to as mattress ticking. Furthermore, under normal circumstances, a mattress is sold in conjunction with a box springs or other support member which is locateable therebeneath and which likewise include a support means by way of an interrelated spring arrangment and an appropriate cover. When the box springs and mattress are sold as a set, the ticking fabric that is applied to the mattress is likewise utilized as a cover fabric for the box springs for the sake of aesthetic continuity.

Ticking fabrics throughout the years have included various and sundry materials with certain basic criteria being considered in the manufacture of same. Particularly, the fabric should have adequate strength and cover to enclose the contents of the mattress or the box springs and support the anticipated human weight, should preclude against creation of tactile impressions of the support means on the individual residing on the mattress, should be aesthetically pleasing, should be economical, and peferably should be treated for water and stain resistance. The ticking fabrics may include a padding layer to preclude tactile transmission of the support means therethrough or conversely, a separate layer may be provided between the support means and the ticking fabric. Historically, as mentioned above, various and sundry types of fabrics have been utilized for mattress ticking, and economics has played a major role in decisions as to the type fabric to be employed. By way of example, for many years, conventional cotton fabrics were woven with a striped design that became symbolic of a ticking fabric look. More recently, due to the increase in price of cotton as well as the availability of the manmade fibers, there has been a tendency to move away from the cotton ticking and to utilize fabrics that are manufactured wholly from manmade fibers or from blends of cotton and manmade fibers. At the same time, such fabrics have customarily been coated with materials to improve the optical qualities of the fabric, to upgrade cover of the fabric and to provide a suitable substrate for the printing of aesthetic designs thereon.

Particularly insofar as fabrics including manmade yarns or fibers are concerned, the surface of the ticking fabrics offers less frictional resistance than a 100% cotton fabric in a plane transverse to the fabric surface. Likewise with cotton fabrics, however, there is a tendency for sheets or other bed coverings, unless they are form fitted to slide across the surface of the fabric, resulting in disarray of the bed, discomfort to one sleeping thereon, and inconvenience to the person making and/or remaking the bed. Further, and very importantly there is a greater tendency of a mattress lying atop a bed springs or other support to move relative to the box springs. Such occurs in retail outlets for the goods where bed covering is not applied and in the home as well.

In the present day market, conventional mattress ticking fabrics are woven polyester cotton fabrics in which the yarns making up the fabric are blends of cotton and polyester fibers, woven jacquard fabrics, and knit fabrics, such as tricots. The woven polyester cotton fabrics and the knit fabrics are normally overprinted with an aesthetic design while the woven jacquard fabrics include aesthetic designs that were produced in the fabric during weaving. The woven jacquard fabrics while being more substantial in hand and perhaps in aesthetic quality are significantly more expensive than the woven polyester cotton or tricot ticking fabrics, such that jacquards are normally limited in use to more expensive mattresses. Standard woven polyester cotton and tricot fabrics are conventioanlly uutilized in maufacture of the lesser cost goods. With all three types, however, as well as other types presently available, the problem of slippage across the top surface of the mattress is present.

Body supporting elements according to teachings of the 1present invention utilize a particular type fabric which overcomes the slippage problem while being capable of presenting an aesthetic quality similar to jacquard fabrics. In the context of the present invention, the instant ticking fabric may be utilized with one or more of the body supporting elements of a bed, and the term body supporting element is intended to refer to all such elements, as exemplified by mattress, water cells, box springs and the like. Particularly, fabrics according to the present invention include means to resist relative movement of a mattress relative to a box springs or other support on which the mattress freely resides without like restraints, of bed coverings across the upper surface of a mattress and the like. At the same time fabrics produced according to the present invention are capable of being back coated with polymeric foams and the like to achieve an overall fabric having acceptable or improved stiffness and hand quality. Likewise, fabrics utilized in conjunction with body supporting elements according to the present invention may be overprinted with a particular print pattern or conversely, include an aesthetic pattern knitted into the fabric at the time of manufacture.

Insofar as present fabrics, per se, are concerned, yarns are located in a particular arrangement in spaced apart fashion across the upper surface of same, which yarns provide resistive forces against relative movement of an item freely resting thereatop or vice versa. The particular top yarns, which are laid in during fabric manufacture, follow non-linear paths, preferably in pairs with each yarn of a pair preferably following a mirror image path of the other yarn of the pair to provide the resistive forces referred to. Though there is known prior art which includes the provision of decorative yarns laid in during the production of a knit fabric in the longitudinal direction, and along non-linear paths, there is no fabric that is known to exist in which the particular lay in yarns are arranged for the particular purposes of the present invention.

Additionally, the industry has historically been unable to back coat fabrics containing acetate yarns with success, and in fact, both the fiber producers and the chemical suppliers recommend against same. The inability of success of such a coating operation results from the elevated temperatures involved in the application and curing of the coating materials, which are adequate to cause significant degradation of the acetate yarns. Again, however, with the fabrics according to the present invention, same can be successfully back coated with polymeric foams under normal process conditions without experiencing any apparent degradation of the acetate yarns.

SUMMARY OF THE INVENTION

It is an object of the present inventin to provide an improved body supporting element, the upper surface of which is characterized as having non-slip properties.

Another object of the present invention is to provide an improved body supporting element which utilizes a ticking fabric that has a high friction outer surface.

Yet another object of the present invention is to provide an improved body supporting element which utilizes a ticking fabric that approaches the qualities and characteristics of a woven jacquard fabric at a more economical price, and which has improved surface characteristics.

Still further, another object of the present invention is to provide an improved decorative fabric that exhibits a high friction outer surface.

Yet another object of the present invention is to provide an improved knit ticking fabric having non-slip qualities along its upper surface.

Still further, another object of the present invention is to provide an improved fabric that includes acetate yarns, which fabric may be successfully coated at temperatures above the degradation point of the acetate yarns, but without any apparent degradation of same.

Generally speaking, the body supporting element of the present invention that exhibits a non-slip outer surface comprises a conventional framework; support means associated with the framework; and a ticking fabric that is secured around the outer periphery of the element, said fabric comprising a base knit structure having adquate strength to support a human body and to enclose at least a portion of said element, said base knit structure having a plurality of first yarns laid atop same and secured thereto, said first top yarns residing above said base structure and following a non-linear path therealong, and second top yarns laid atop said base knit structure and being secured thereto, said second top yarns following a non-linear path along said fabric that produces a mirror image to said first top yarns, whereby said first and second yarns cooperate to produce a slip resistant surface.

More specifically, the ticking fabrics used on body support elements according to teachings of the present invention include a plurality of pairs of lay in yarns that are introduced to the knitting machine longitudinally with respect to the fabric being produced. Bars to which the lay in yarns are fed are oscillated back and forth across the machine to deposit the lay in yarns along mirror image, non-linear paths. As the lay in yarns are introduced to the knitting machine, same are locked into the fabric by the knit stitches, while remaining above the upper surface of the base fabric.

After the fabric leaves the knitting machine, according to a preferred embodiment, yarns of the base structure are tinted in a pad bath and the fabric is heat set at open width in a tenter frame. Thereafter, the heat set fabric is passed upside down beneath a coating head where a back coating composition, preferably a latex foam composition is applied to the underside of the fabric. The coated fabric is then passed through a curing oven where the latex foam is cured, after which the fabric passes around cooling cans and is taken up. Subsequently, if desired, the coated fabric may be passed through a printing operation where a predetermined aesthetic design is printed by roller printing or the like across an upper surface of same followed by drying and take up. Subsequent to the coating operation or printing, if employed, a protective fluorocarbon type chemical may be applied thereto, to impart water-resistat, stain resistant, or other characteristics, after which the fabric is further heat set at open width. The finally finished fabric may then be taken up for transport to the mattress manufacturer.

With the pairs of upstanding surface yarns secured to the upper surface of the base fabric, items contacting the upstanding yarns encounter resistance to movement relative to the fabric in all directions. Bed coverings, for example, once placed on a mattress better remain in place than with a conventional mattress. In like fashion, the mattress per se is resistant to movement across an upper surface of a box springs or other support located therebeneath, and on which the mattress freely resides without restraints.

DESCRIPTION OF THE PREFERRED EMBODIMENTS

Figures 1, 9:
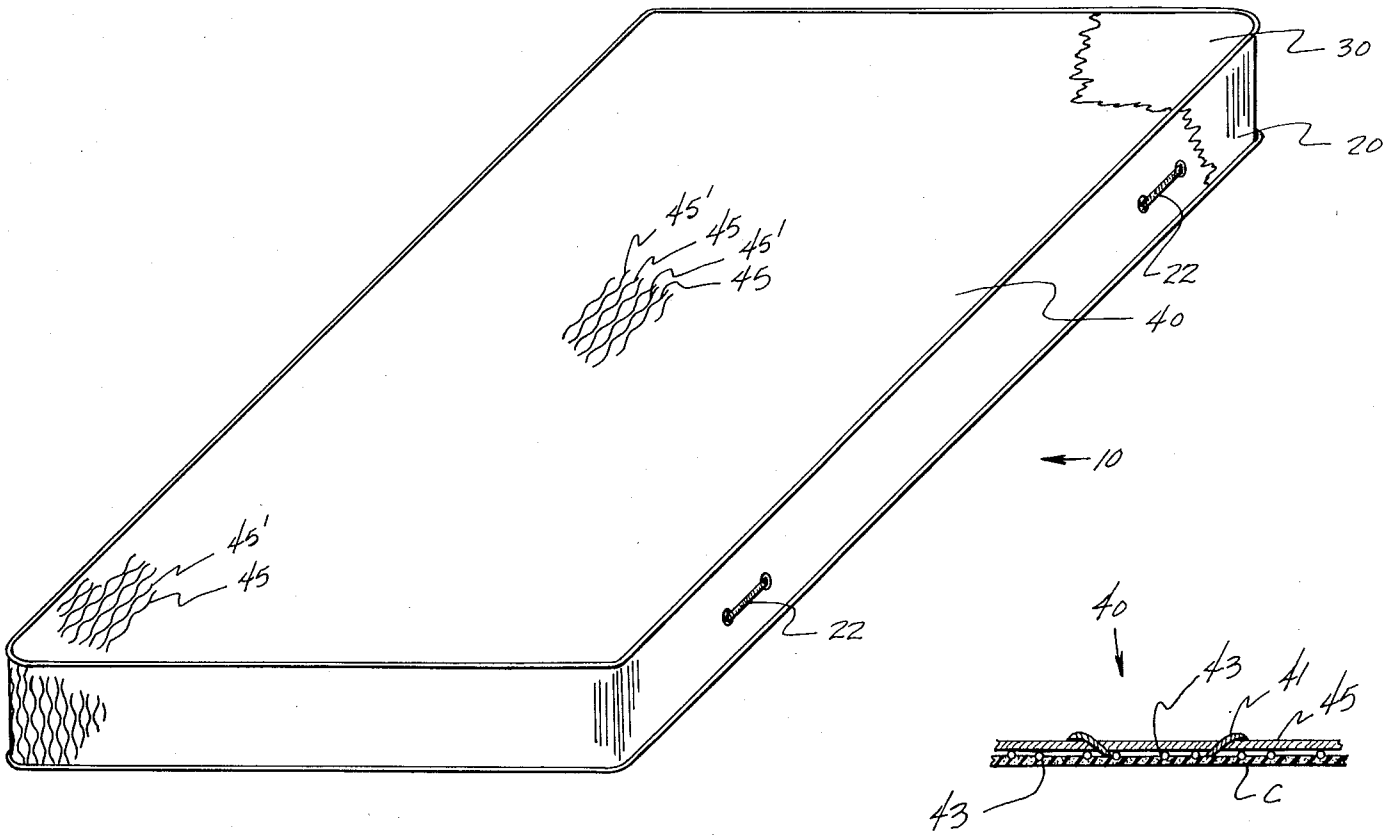
FIG. 1 is an isometric view of a mattress shown in partial cross section as exemplary of a body support element according to teachings of the present invention.
FIG. 9 is a vertical cross section through a portion of a fabric according to teachings of the present invention that is back coated with a polymer foam.

Making reference to the Figures, preferred embodiments of the present invention will now be described in detail. FIG. 1 illustrates a body support element, e.g. a mattress generally indicated as 10 according to teachings of the present invention having a frame or border 20 surrounding the periphery of same with appropriate support means 30 received within frame or border 20 for providing resilient support to an individual sitting or lying thereon in a supine position. A ticking fabric of the present invention generally 40 is partially illustrated across the surface of mattress 10 with upstanding lay in yarns 45, 45' being partially illustrated thereon. Fabric 40 is preferably be located completely around mattress 10.

Figure 2:
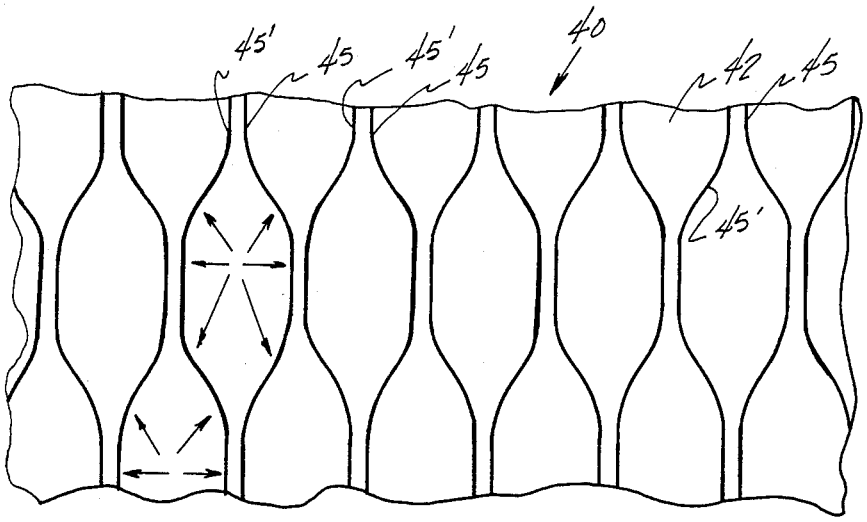
FIG. 2 is an illustration in greater detail of a ticking fabric according to teachings of the present invention.

As can be seen in FIGS. 1, 2 and 9, ticking fabric 40 has a knitted base 42 with yarns 45, 45' being laid in on the knitting machine at the time of manufacture of the fabric along non-linear paths. Lay in yarns 45, 45' are secured within the knit stitches of the base structure 42 according to conventinal knitting techniques. As particularly shown in FIG. 2, each yarn 45, 45' follows a mirror image, non-linear path with respect to its opposite yarn, whereby as shown by the arrows, a frictional resistance from upstanding yarns 45, 45' will be produced in all directions. More particularly, with the non-linear mirror image arrangement as illustrated, movement of the mattress with respect to a support located therebeneath or a bed covering along any vector will encounter lay in yarns 45, 45' substantially normal thereto.

Figure 3:
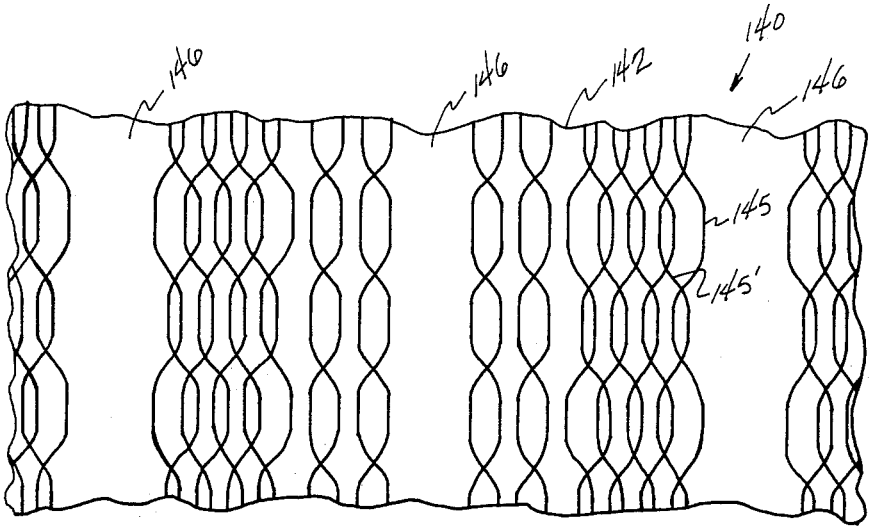
FIG. 3 is a further fabric for use as a ticking according to teachings of the present invention.

FIG. 3 illustrates a further fabric embodiment according to teachings of the present invention where a plurality of pairs of lay in yarns 145, 145' are arranged in pair groupings atop base fabric 142 with a space 146 located between the various pair groupings in which no lay in yarns are secured to the base fabric. Accordingly, as can be seen from FIG. 3, it is not necessary that a continuum of non-linear lay in yarns 145, 145', etc. be located across the entire width of the fabric 140. Spaces 146 between the pair groupings may thus vary. It is only necessary, whatever grouping arrangment is employed, that the resistive forces are present in generally all directions, and that sufficient lay in yarns be present to cooperatively afford adequate resistive force against relative movement of a bed covering across a mattress; a mattress across a box springs, or the like.

Figure 4:
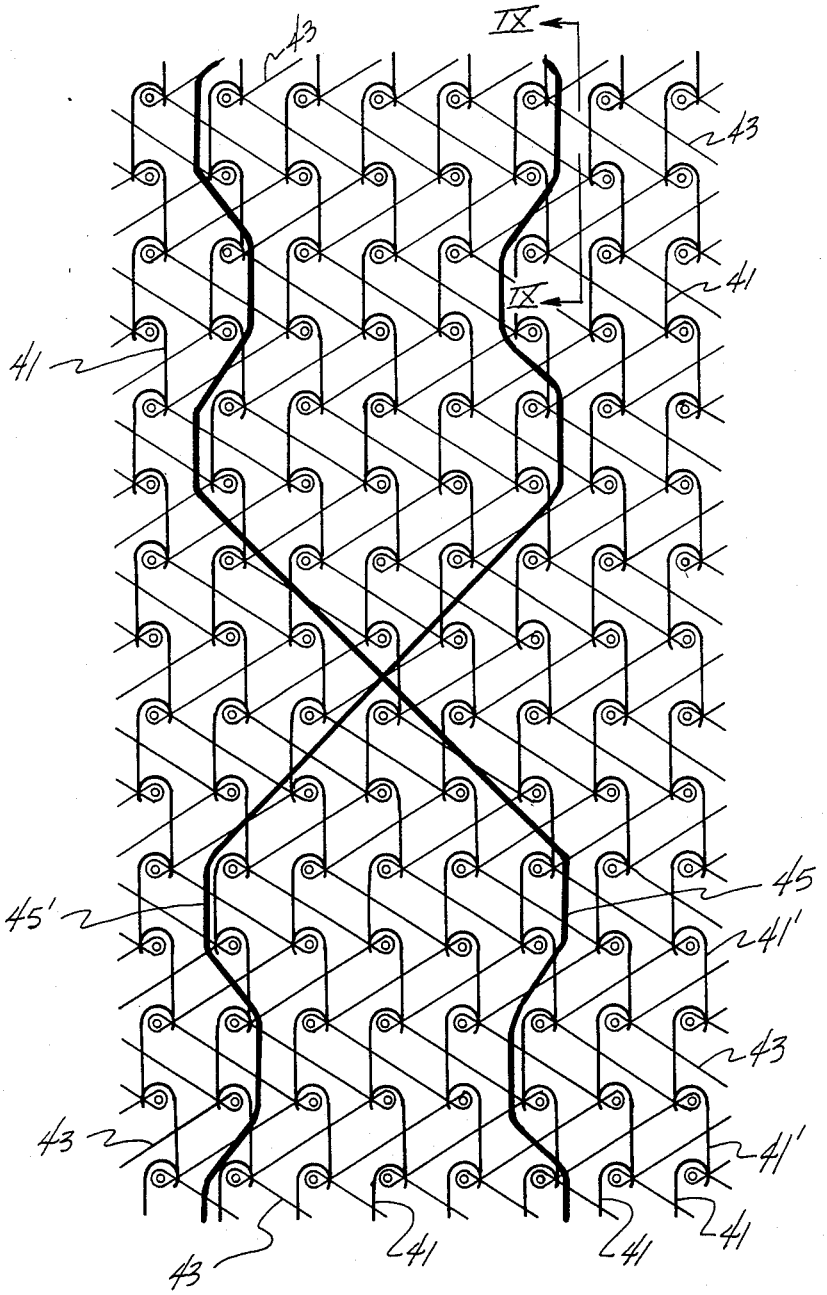
FIG. 4 is a stitch diagram of a preferred fabric embodiment according to teachings of the present invention.

In order to further demonstrate particular types of fabrics that are suitable for use according to teachings of the present invention, an exemplary fabric design in particularly illustrated in FIG. 4. A plurality of yarns 41, such as 40 denier filament polyester, are fed to the first bar of a raschel warp knitting machine (not shown), with bar 1 being interrelated with the knitting needles to produce a plurality of chain stitches 41'. Bars 2 and 3 of the knitting machine receive the lay in yarns 45 45' and are contacted by cams or other suitable means to follow the non-linear mirror image paths along the length of the fabric. A further knitting yarn 43, for example, 75 or 100 denier bright acetate staple yarn was fed to bar 4 and serves as a crossover yarn which, when incorporated with the chain stitches of bar 1 forms the base fabric structure 42. As illustrated in the design in FIG. 4, the crossover yarns 43 lap around a first needle, thereafter move diagonally forward one needle position and across at least one needle row, wrapping around a diagonally opposite needle and returning diagonally to the original needle row, again, however, moving upwardly one needle position. Such occurs across the width of the fabric and provides the cover factor for base fabric structure 42. Lay in yarns 45, 45' as they cross needle rows, are interengaged with the chain stitches to be fully integrated into the fabric structure. Due to the fineness of the chain stitch yarns, however, the lay in yarns appear to be resting unattached or floating along the top surface of the ticking fabric.

As mentioned hereinbefore, it may be desirable to back coat fabrics according to teachings of the present invention to improve the handle and/or stiffness of the fabric. Making reference to FIGS. 5–8, certain finishing processes that may be desirable for fabrics according to the present invention will be generally described. Each of these particular processes is well known and well established in the art, such that a general description of each should suffice to enable one skilled in the art to practice the invention.

Figure 5:
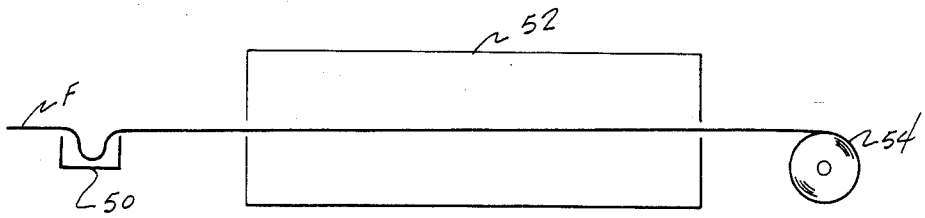
FIG. 5 is a schematic illustration of the tinting and heat setting process for fabrics according to teachings of the present invention.
Figure 6:
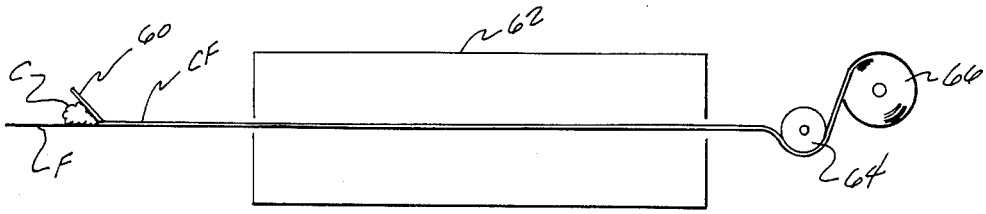
FIG. 6 is a schematic illustration of a foam back coating process for ticking fabrics according to teachings of the present invention.

Subsequent to removal of the fabric from the knitting machine, the fabric F is passed through a pad bath 50 that contains a dyestuff composition appropriate for tinting the base fabric structure 42, while avoiding adverse dye effect on the lay in yarns 45 45', if a contrast is desired (See FIG. 5). Such is permitted due to the particular tint compositions utilized, the short residence time in the pad bath, and the type of yarns employed. Subsequent to the pad bath 50, fabric F passes through a tenter frame 52 where the fabric is maintained at full width under temperature conditions adequate to heat set the synthetic yarns employed in the fabric, generally in a range of from about 350° to about 375° F., and is thereafter taken up on conventional take up means 54 in roll form. Referring to FIG. 6, fabric F is fed upside down beneath a coater head 60 where a quantity of a coating composition C such as a latex foam composition is applied to the underside of the fabric (See also FIG. 9). Coater head 60 is in essence a doctor blade that controls the amount of application of composition C to the fabric from a puddle of same. Subsequent to the coating head 60, the coated fabric CF then passes through a suitable curing oven 62 where the latex is cured and foamed at temperatures generally also in a range of from about 350° to about 375° F. Likewise, however, other back coating compositions as conventionally employed in the art may be applied at coating head 60. Subsequent to curing oven 62, coated fabric CF is cooled as by one or more cooling cans 64 and is then taken up in roll form on a conventional take up means 66.

Figure 7:
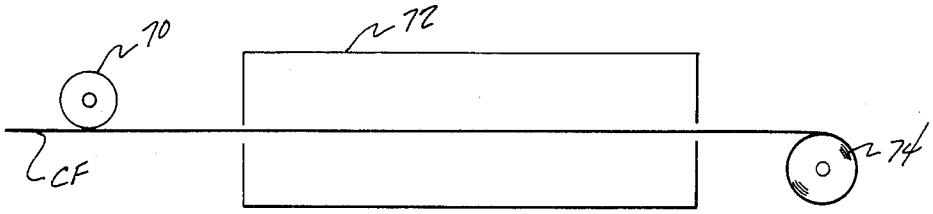
FIG. 7 is a schematic illustration of a process for printing the upper surface of fabrics according to teachings of the present invention.
Figure 8:
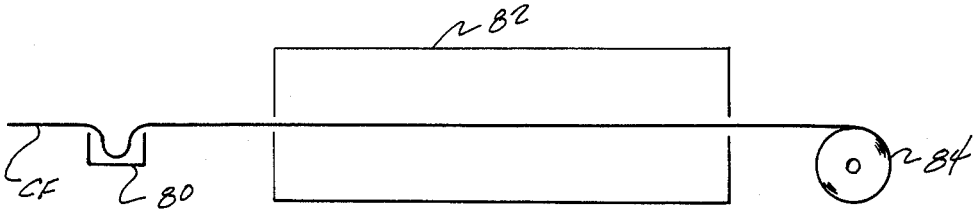
FIG. 8 is a schematic illustration of a process for adding a protective coating to fabrics according to teachings of the present invention and further heat setting same.

If desired, subsequent to coating of the fabric, as illustrated in FIG. 7, the coated fabric may be passed through an appropriate printing range, whereby roller or other type printing means schematically indicated as 70 print a particular design or motif onto an upper surface of coated fabric CF, purely for enhancement of the aesthetic effects of fabric CF. Subsequent to the print station 70, the printed fabric CF passes through an appropriate oven 72 where the fabric is dried, after which fabric CF is taken up in roll form on a conventional take up means 74. As a final step in the processing of fabric according to teachings of the present invention, the coated fabric CF may be passed through yet a further pad bath 80 where appropriate fluorocarbon or other type chemical compositions may be applied thereto as a protective coating for the fabric, followed by a further heat set operation in a tenter frame 82 and take up on roll means 84. The coated fabric CF may thus have a water resistant, stain resistant, or other type surface quality as dictated by the particular end use imparted thereto.

It is generally accepted in the art, both as from a chemical manufacturer's standpoint and a fiber producer's standpoint that acetate type yarns may not be back coated as illustrated above. Particularly, at temperatures in a range of 350° and 370° F. to which the fabrics according to the present invention are subjected in the four process steps outlined above, serious degradation of the acetate yarn normally occurs. In fact, under normal conditions, when an acetate yarn is subjected to a temperature in a range of about 370° F. for a short period of time, the acetate yarn becomes quite brittle, thus negating any worthwhile use of a fabric embodying same. Strangely enough, however, according to the present invention where the acetate yarn is preferred due to its cost and sheen to provide the cover for the base fabric structure, after heat setting same at a temperature of around 370° F., and coating the fabric as outlined above, no degradation of the acetate is apparent.

While certain design configuration and stitch constructions have been described above for fabrics according to the present invention suitable for ticking having a non-slip upper surface, obviously other fabric constructions and other design variations of the lay in yarns may be utilized. In like fashion, the particular yarns listed in describing a preferred fabric according to the present invention should not be considered as limiting, and any other type of yarn that would be suitable for such end use and to the fabric manufacturing process may be utilized.

Having described the present invention in detail, it is obvious that one skilled in the art will be able to make variations and modifications thereto without departing from the scope of the invention. Accordingly, the scope of the present invention should be determined only by the claims appended hereto.

That which is claimed is:

1. A body support element having non-slip surface characteristics comprising:

(a) a frame, (b) support means within said frame;

(c) ticking fabric secured about at least a portion of said frame, said ticking fabric comprising a base knit structure having adequate strength when on said element to support a human body in a supine position, said base knit structure having a plurality of first yarns laid atop same and secured thereto, said first top yarns residing above said base structure and following a non-linear path therealong and a plurality of second yarns laid atop said base structure and secured thereto, said second yarns residing above said base structure and following mirror image paths to said first lay in yarns whereby frictionally resistive forces are present across the surface of the element.

2. A body support element as defined in claim 1 wherein said fabric is back coated with a polymer foam.

3. A body support element as defined in claim 1 wherein said fabric is a warp knit fabric.

4. A body support element as defined in claim 1 wherein said first and second yarns are located in pairs in spaced apart pair groupings across an upper surface of said element.

5. A body support element as defined in claim 1 wherein said ticking fabric is a raschel knitted fabric.

6. A body support element as defined in claim 1 wherein said ticking fabric is a warp knit fabric comprising a plurality of adjacent chain stitches, a cross over yarn interconnecting said rows of chain stitches and wherein said first and second top yarns are laid along said fabric in pairs and are secured to said fabric by said loops of said chain stitches.

7. A body support element as defined in claim 6 wherein said cross over yarns of said ticking fabric are bright acetate, and wherein said ticking fabric is back coated with polymer foam.

8. A body support element as defined in claim 7 wherein an upper surface of said ticking fabric is printed.

9. A non-slip body support element for a bed comprising:

(a) means for supporting a human body to be received thereon; and (b) a ticking fabric secured about said support means, said ticking fabric comprising a knit fabric including a plurality of pairs of lay in yarns along a top surface of same, said pairs of lay in yarns being spaced apart from adjacent pairs of lay in yarns, following non-linear paths across said fabric, said lay in yarns cooperating to provide resistive forces to a further element freely received thereon.

10. A body support element as defined in claim 9 wherein said fabric is back coated with a polymeric foam.

11. A body support element as defined in claim 10 wherein said fabric includes groups of spaced apart pairs of lay in yarns on said upper surface, said yarns in said pairs following mirror image paths along said fabric with respect to the other in each said pair.

12. A body support element as defined in claim 9 wherein said fabric is a warp knit fabric comprising a plurality of adjacent chain stitches, and a plurality of cross over yarns interconnected with said chain stitches according to a predetermined pattern and said lay in yarns being interconnected with said chain stitches to be bound to said upper surface of said fabric thereby.

13. A body support element as defined in claim 12 wherein said cross over yarns comprise a majority of the cover for said fabric and are acetate type yarns, and wherein said fabric is back coated with a polymeric foam.

14. A ticking fabric charterized by a non-slip upper surface, said fabric including a base knit fabric having adequate strength and cover to support a human body in a supine position when placed over a conventional body support element, said fabric having a plurality of yarns laid in along an upper surface of same, each of said lay in yarns being located above a major axis through said fabric and following non-linear paths along said fabric.

15. A fabric as defined in claim 14 wherein pairs of lay in yarns are provided, and yarns of each pair follow non-linear passageways that produce a mirror image of the other yarn of said pair.

16. A fabric as defined in claim 15 wherein said fabric is a warp knit fabric.

17. A fabric as defined in claim 15 wherein a major constituent of same is an acetate type yarn, and wherein said fabric is back coated with a polymeric foam.

18. A fabric as defined in claim 17 wherein said pairs of lay in yarns are located in spaced apart relationship transverse to the machine direction of said fabric.

19. A fabric as defined in claim 18 wherein said fabric is a raschel warp knit fabric.

20. A fabric as defined in claim 17 wherein an upper surface of same is printed with a predetermined design thereacross.

21. A fabric as defined in claim 14 wherein each yarn of said pair follows a sinusoidal path in the machine direction.

* * * * *